United States Patent [19]

Nelson

[11] 4,218,848

[45] Aug. 26, 1980

[54] PLASTIC FOAM-FILLED DOOR HAVING INTEGRAL PLASTIC HOUSING DEFINING LOCK CYLINDER AND LOCK BOLT CHAMBERS

[75] Inventor: David M. Nelson, Kewanee, Ill.

[73] Assignee: United States Gypsum Company, Chicago, Ill.

[21] Appl. No.: 15,977

[22] Filed: Feb. 28, 1979

[51] Int. Cl.[2] ..... E06B 3/00

[52] U.S. Cl. ..... 49/503; 52/743

[58] Field of Search ..... 49/503, 167; 52/707, 52/743

[56] References Cited

U.S. PATENT DOCUMENTS

| | | | |
|---|---|---|---|
| 1,351,119 | 8/1920 | Ogden | 52/707 X |
| 3,039,291 | 6/1962 | Dusing et al. | 49/503 X |
| 3,156,450 | 11/1964 | Thom | 52/207 |
| 4,118,895 | 10/1978 | Governale | 49/503 |

*Primary Examiner*—Kenneth Downey

*Attorney, Agent, or Firm*—Samuel Kurlandsky; Robert H. Robinson; Kenneth E. Roberts

[57] ABSTRACT

A door formed of a pair of spaced-apart metal skins and a core provided intermediate the skins composed of a foamed plastic material. A plastic housing is provided having a wall substantially perpendicular to and engaging the metal skins and cooperating therewith to define a lock cylinder chamber and a communicating lock bolt chamber and preventing the foam plastic material from entering the chambers.

10 Claims, 3 Drawing Figures

PLASTIC FOAM-FILLED DOOR HAVING INTEGRAL PLASTIC HOUSING DEFINING LOCK CYLINDER AND LOCK BOLT CHAMBERS

BACKGROUND OF THE INVENTION (1) Field of the Invention

The present invention relates to doors, and is more particularly concerned with a door having outer sheet metal skins and a foamed-in-place core.

(2) Prior Art

It was formerly conventional to construct doors with a wood frame and wood paneling. It was then customary for the carpenter working on the job site to drill a transverse bore to receive the lockset and to drill a bore in the edge of the door communicating with the first bore to house the bolt. In order that the lock be operational, it was necessary for both the lock cylinder bore and the bolt bore to be drilled with extremely high precision. Moreover, it was necessary to utilize special tools for this process.

Eventually, many doors were made of steel sheets forming spaced-apart skins with foamed-in-place cores formed between the skins. The problem of providing bores for the lockset and the bolt became more acute since it was difficult to provide precision placed openings in the steel skins and also in the core at the job site. It then became conventional to provide precut apertures in the door for both the lock cylinder and the bolt. However, it then became necessary to retain lock cylinder and bolt chambers free of foam when the core was foamed in-place.

In U.S. Pat. No. 4,118,985 there is disclosed a liner to be inserted in a door to provide the lock cylinder and bolt chambers and to provide for the chambers to remain free of foam after the space between the skins are filled with foam. The structure comprises a tube having its axis positioned transverse to the skins and a second and smaller tube formed in the side wall of the larger tube and positioned radially therefrom. The large tube is retained between the skins and the small tube is inserted through an aperture provided in the edge of the door. This structure performs the task for which it was designed. However, there is no means provided for fastening the structure to the door prior to foaming except for the insertion of the small radial tube into the edge bore of the door. Moreover, the insert must be formed by injection molding of a plastic material. Both the process and the dies necessary for carrying out the process are very expensive.

SUMMARY OF THE INVENTION

It is therefore an object of the invention to provide a door comprising sheet metal skins and a foamed-in-place plastic core.

It is another object to provide a door of the type described having a housing insert mounted between the sheet metal skins defining a lock cylinder chamber and a lock bolt chamber communicating therewith.

It is an additional object to provide a housing insert of the type described arranged to engage the sidewalls of the sheet metal skins of the door and to prevent the plastic foam material which is foamed in place in the door from filling in the lock cylinder chamber and lock bolt chamber.

It is another object to form the housing insert of a plastic material which has a low heat conductivity coefficient.

It is another object to provide a housing insert of the type described which may be relatively inexpensively formed by an inexpensive process and by relatively inexpensive apparatus.

Still other objects and advantages of the invention will readily present themselves to one skilled in the art upon reference to the following specification, the drawing, and the claims.

According to the invention, chamber-defining inserts are formed by extruding a tubular structure from a plastic material and subsequently utilizing cross-sectional slicing or cutting to form plastic inserts of the desired width to fit between the sheet metal skins of the door. The structure is preferably substantially circular for a large part thereof to define with the sheet metal skins a lock cylinder chamber, opening at a constricted portion and extending into substantially parallel portions to define a lock bolt chamber, and then terminating in outwardly extending feet for engaging and being affixed to the inner edge or stile of a door. The insert is placed with its feet engaging the inner portion or stile of the door and affixed thereto by means such as staples driven through the feet and into the wood of the stiles. Predrilled skins are then affixed in place and a plastic material is foamed into place inside the door. The housing insert acts as a fence and prevents the foam from entering into the lock chambers. The resulting structure is rigid and strong and additionally acts as a support for the skins in the area of lock members.

DESCRIPTION OF THE PREFERRED EMBODIMENT

Figure 1:
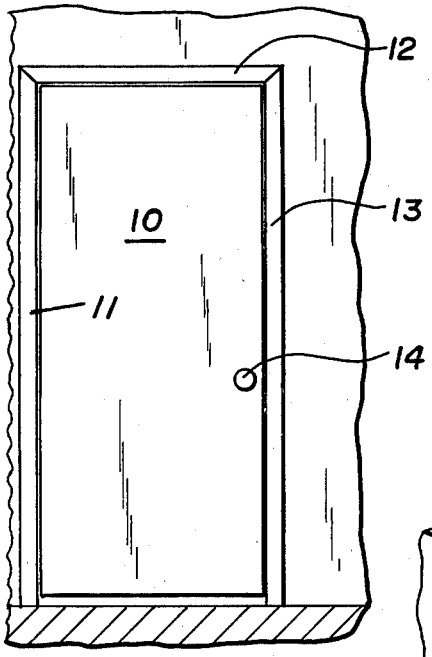
FIG. 1 is an elevational view of a door according to the invention.

Referring to FIG. 1, a door 10 is shown mounted in a doorway comprising a hinge jamb 11, a header 12, and a strike jamb 13. A door knob 14 is mounted in the door.

Figure 2:
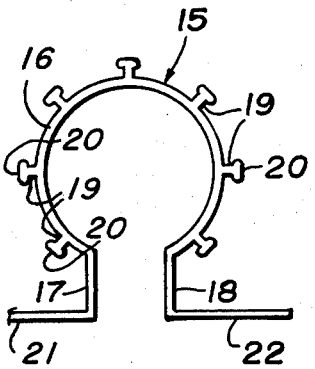
FIG. 2 is an elevational view of a lock housing insert.

Referring to FIG. 2, a lock housing insert 15 is shown according to the invention. The insert is formed by extruding a plastic structure having the cross-section shown in FIG. 2. The extruded structure is then transversely cut to form a plurality of inserts 15 having a width equal to the distance between the outer skins of the door in which the insert is to be mounted. As shown in FIG. 2, the lock housing insert comprises a lock cylinder housing portion 16 which is substantially circular, and lock bolt housing portions 17 and 18 which are substantially straight and parallel with respect to each other. The lock cylinder housing portion has a plurality of axially oriented ribs 19 having enlarged ends 20 for being embedded in the rigid foam structure of the door and preventing the foam from pulling away from the insert. The lock bolt housing portions 17 and 18 terminate with a pair of feet 21 and 22, respectively, substantially at right angles to the lock bolt housing portions 17 and 18 and substantially coplanar with respect to each other.

Figure 3:
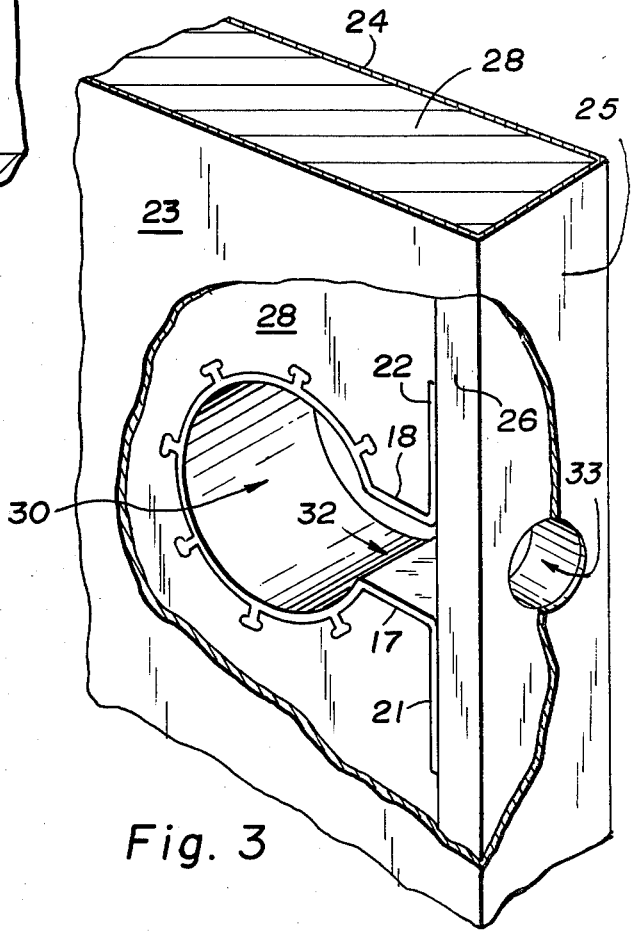
FIG. 3 is a perspective fragmentary view, partly broken away, of a portion of a door having the lock housing insert mounted in the door.

Referring to FIG. 3 a door portion is shown comprising sheet metal skins 23 and 24, and an edge skin 25. A wood style is mounted at the edge of the door and has the feet 21 and 22 of the insert 15 affixed thereto by means such as staples. The interior of the door is filled by foamed-in-place polyurethane foam 28 which fills the entire door except for the lock cylinder chamber 30 and the lock bolt chamber 32. The lock bolt bore 33 is provided in the wood style 26 by means such as drilling.

In forming the door of the present invention, the steel skins are formed and cut to size, and embossed if desired. If desired wood frames may be utilized at the top and bottom of the door for spacing the skins. Steel hinge reinforcements may be provided at the hinge edge of the door. The metal skin may be folded over on top of the wood frame. Various methods known in the art may be utilized for assembling the door. A wood stile is generally utilized on the edge of the door which contains the lock. The lock bolt bore is drilled into the edge of the door. It can for example have a one inch diameter or can be made to receive a one inch by 2⅛ inch rectangular plate. Larger round holes are provided in the skins generally about 2⅛ inch in diameter, but always of a smaller diameter than the diameter of the insert. The steel skins are punched in such a manner that a lip is formed around the lock cylinder holes which fit inside the plastic insert and holds it in place. The plastic housing insert is put in before the skins are applied in place. In assemblying the door, the bottom skin is positioned horizontally on the floor or on a table. Various frame members and inserts are positioned over the bottom skin. The feet of the lock housing insert 15 are then affixed to the wood style by means such as staples. The plastic lock housing insert is positioned over the hole provided for the lock cylinder with the lip of the skin entering the chamber of the insert and maintaining it in place. The top skin is then placed over the assembly and affixed thereto. The door assembly is then placed in a mold. A hole is provided on the hinge edge of the door and foam is injected into the hole. The entire door is filled by the foam except for the lock cylinder chamber 30 and lock bolt chamber 32. A suitable foam for use in the present door is polyurethane foam. After foaming, the hole utilized for injecting the foam is plugged. The lock housing insert 15 serves to protect the door in the vicinity of the lock and to prevent its being crushed. The ribs 19 with their enlarged ends 20 become embedded in the foam and prevent the foam from pulling away from the insert.

The lock housing insert of the present invention and the door fabricated therewith have a number of advantages over prior art structures, particularly over structures such as disclosed and claimed in U.S. Pat. No. 4,118,895. The present insert is formed of a plastic material. Consequently, it does not serve to conduct much heat from one skin of the door to the other. The metal insert of previous structures conducts considerable heat from one skin to the other. A further advantage in the present structure is that it can be fabricated by extruding a long section and then forming individual inserts by transversely cutting the section. In contrast, the plastic insert of the structure of U.S. Pat. No. 4,118,895 must be formed by injection molding. It is estimated that the mold to form the patent structure would cost about $70,000. In contrast the tooling for extruding the present structure only costs about $1,000. Moreover, the present structure is easily stapled to the style of the door. In regard to the patented structure, the insert is retained in place only by virtue of the fact that the cylindrical neck is inserted part-way into the bore for the lock bolt. This does not provide positive retention.

It is to be understood that the invention is not to be limited to the exact details of composition, materials or operation as shown or described, as obvious modifications and equivalents will be apparent to one skilled in the art.

Invention is claimed as follows:

1. A door comprising frame means including a swinging edge stile having a lock bolt opening therein, a pair of space-apart metal sheets having axially aligned lockset door openings therein and forming the outer surfaces of said door, and a core of a rigid foamed plastic material disposed intermediate said metal sheets, a lock housing insert formed of a rigid plastic material having a thin wall substantially perpendicular to said spaced-apart metal sheets and having its edges in contact engagement with said spaced-apart metal sheets, said lock housing insert comprising a lock cylinder housing member cooperating with said metal sheets to define a lock cylinder chamber, and a lock bolt housing member cooperating with said metal sheets to define a lock bolt chamber, said lock bolt housing member terminating in a pair of legs extending outwardly and oppositely to each other, said legs being coplanar and being affixed to said stile, said lock cylinder chamber and said lock bolt chamber being substantially free of said foamed plastic material, said door being adapted to have a lockset assembly mounted within said lock housing insert having a lock cylinder member disposed within said lock cylinder chamber and a lock bolt member disposed within said lock bolt chamber.

2. A door according to claim 1, wherein said lock housing insert is prepared by extruding an elongated member having a cross-section in the form of said insert, and transversely cutting said elongated member to provide a plurality of said inserts.

3. A door according to claim 1, wherein said lock cylinder housing member is substantially circular, and said lock bolt housing member comprises extensions of a constricted portion of said lock cylinder housing member and is comprised of planar substantially parallel portions having said feet at the ends thereof.

4. A door according to claim 1, wherein a plurality of axially oriented ribs are positioned on the outer periphery of said lock cylinder housing member for engaging said plastic foam material to prevent said lock housing insert from moving with respect thereto.

5. A door according to claim 4, wherein said ribs are provided with enlarged outer edges.

6. A door according to claim 1, wherein said plastic foam material is polyurethane.

7. An intregral lock housing insert formed of a rigid plastic material adapted to be inserted in a door, said door comprising a frame including a stile, outer spaced-apart metal sheets and a rigid plastic foam core, said insert having opposite edges adapted to engage said parallel spaced-apart metal sheets and to cooperate with said sheets to define a lockset chamber free of said plastic foam, said insert comprising a substantially circular lock cylinder housing member defining a lock cylinder chamber and terminating at a constricted portion in a pair of spaced-apart substantially parallel members comprising a lock bolt housing defining a lock bolt chamber, said lockbolt housing member terminating in a pair of oppositely directed substantially coplanar legs adapted to be affixed to the stile of said door.

8. A lock housing insert according to claim 7, wherein said insert is prepared by extrusion to form an elongated member having a cross-section in the form of said insert, and transversely cutting said elongated member to provide a plurality of said inserts.

9. An insert according to claim 7, wherein a plurality of axially oriented ribs are positioned on the outer periphery of said lock cylinder housing member adapted to engage said plastic foam material to prevent said lock housing insert from moving with respect thereto.

10. An insert according to claim 9, wherein said ribs are provided with enlarged outer edges.

* * * * *